United States Patent [19]

Wiig

[11] 4,304,114

[45] Dec. 8, 1981

[54] PROCESS OF ROLLING AUTOMOBILE RIMS

[75] Inventor: Chester M. Wiig, Lincolnwood, Ill.

[73] Assignee: F. J. Littell Machine Company, Chicago, Ill.

[21] Appl. No.: 897,915

[22] Filed: Apr. 19, 1978

[51] Int. Cl.[3] ..... B21H 1/10; B21D 5/14

[52] U.S. Cl. ..... 72/130; 29/159.1; 72/131; 72/132; 72/168; 72/171; 72/175; 72/381

[58] Field of Search ..... 29/159 R, 159.1, 159.3; 72/129, 131, 166, 168, 169, 170, 171, 172, 173, 174, 175, 381, 383, 384, 388, 130, 132; 113/116 W; 140/88

[56] References Cited

U.S. PATENT DOCUMENTS

| | | | |
|---|---|---|---|
| 2,197,906 | 4/1940 | Tucker | 72/175 |
| 2,675,849 | 4/1954 | Greenshields et al. | 72/171 |
| 3,440,705 | 4/1969 | Johnson | 29/159 R |
| 3,738,149 | 6/1973 | Archer | 72/171 |
| 3,934,324 | 1/1976 | Hess et al. | 29/159.1 |
| 4,082,935 | 4/1978 | Lampietti et al. | 29/159.1 X |
| 4,132,106 | 1/1979 | Bihler | 72/384 |

FOREIGN PATENT DOCUMENTS

| | | | |
|---|---|---|---|
| 1009588 | 6/1957 | Fed. Rep. of Germany | 72/173 |
| 1073425 | 1/1960 | Fed. Rep. of Germany | 72/173 |

*Primary Examiner*—Ervin M. Combs
*Attorney, Agent, or Firm*—Russell H. Clark

[57] ABSTRACT

The invention relates to a method of rolling tire rim blanks from flat metal strips obtained by unwinding strip material from a coil which is cut into strips of desired lengths which are then rolled into a circular shape by anvil rolls cooperating with bodily moveable bending rolls producing a controlled flat portion on the leading end of the strip prior to rolling and another controlled flat portion on the trailing end of the strip following the rolling.

5 Claims, 16 Drawing Figures

Figure 1:
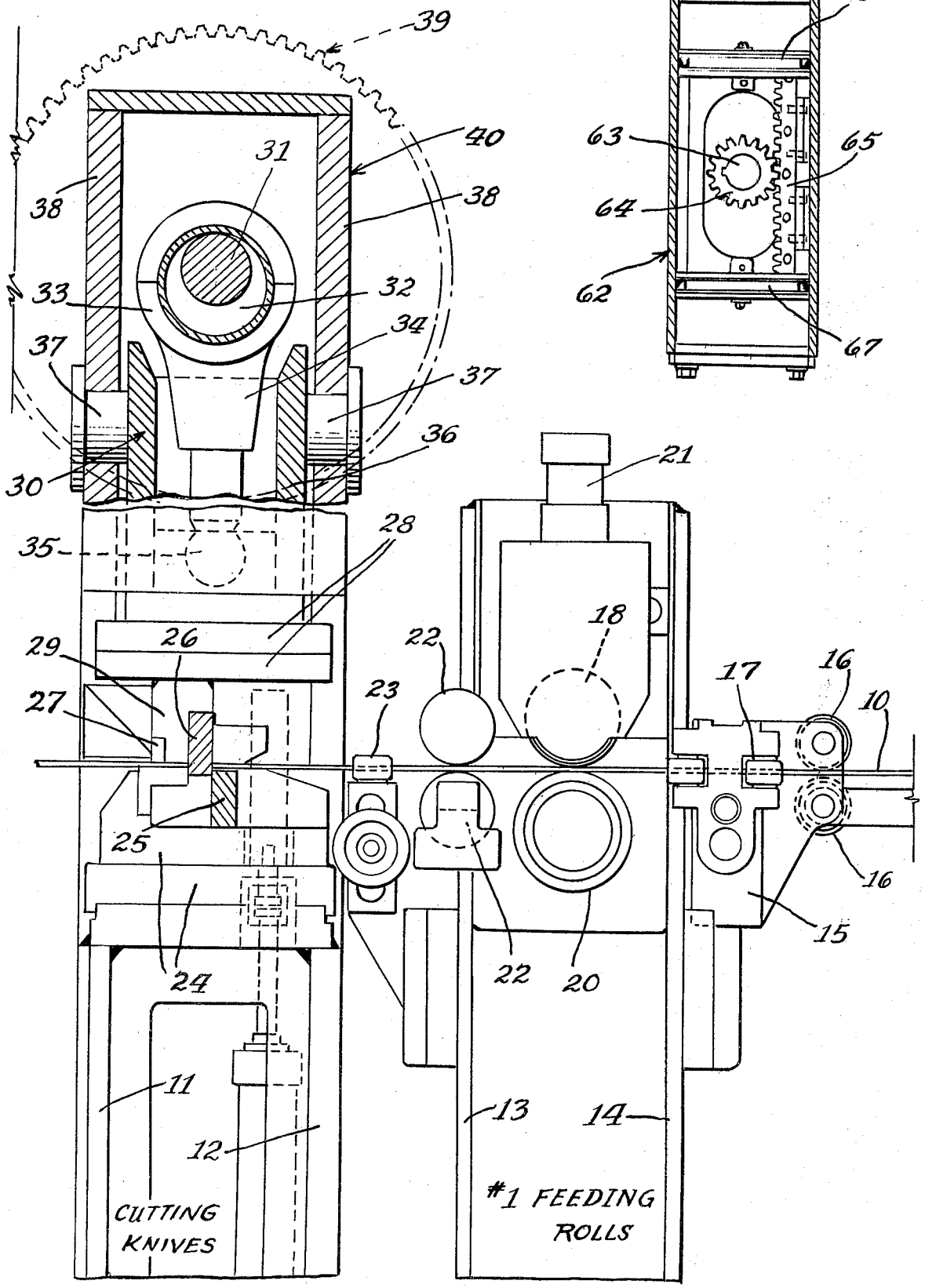

180
181
180
180
181
180
179
173
178
178
179
176
176
167
177
168
168
172
172
175
175
170
178
173
173
174
174
168
166
171
168
170
174
171
174

NO. 1 FEEDING ROLLS
FIRST UNITARY MACHINE
SECOND UNITARY MACHINE
NO. 2 FEEDING ROLLS
NO. 3 FEEDING ROLLS
16
17
18
20
22
25
26
30
31
32
34
35
39
40
41
42
43
44
45
48
54
55
62
71
73
98
128
132
134
135
136
145
166
184
185
186
187

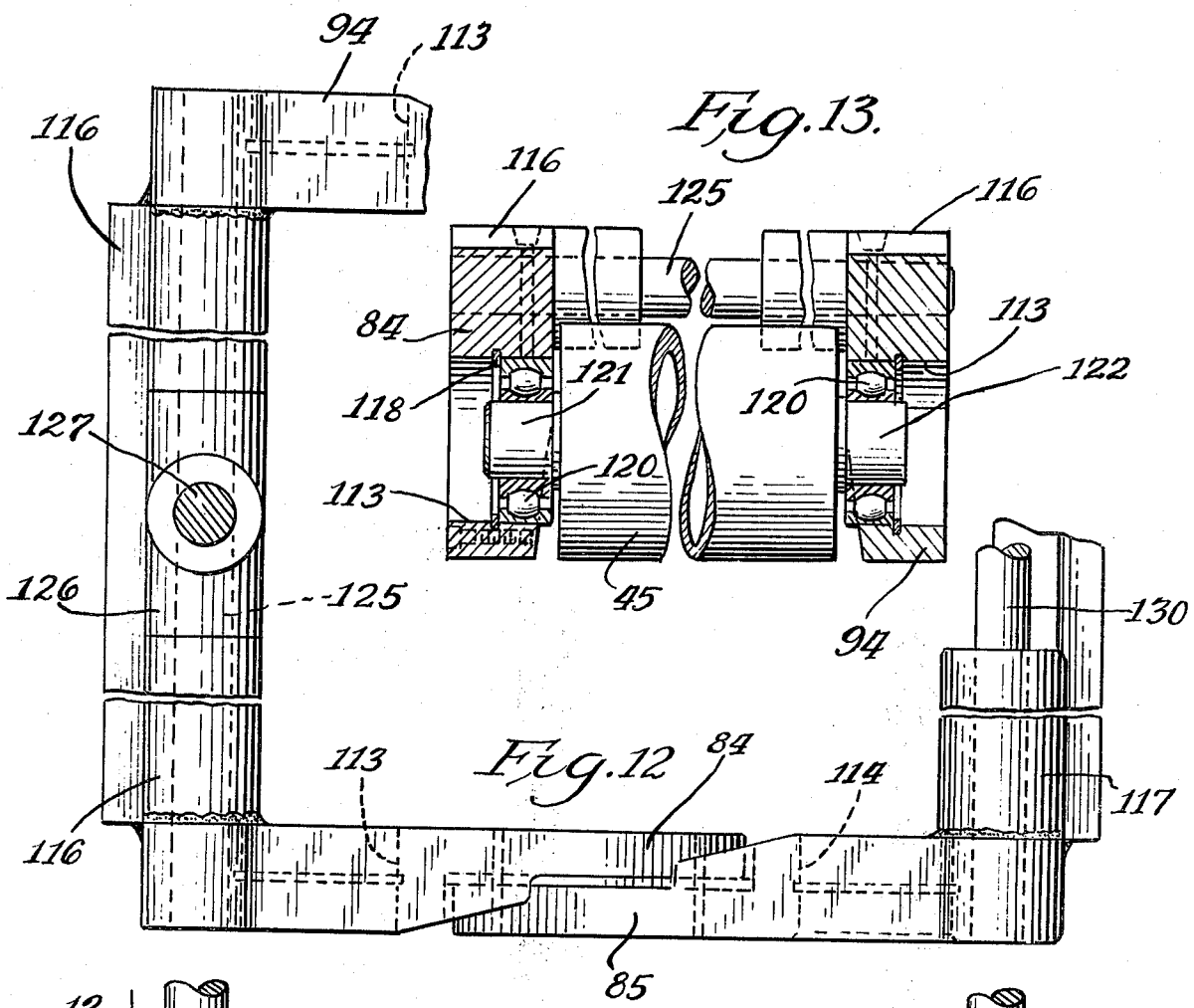
Fig. 13.
Fig. 12
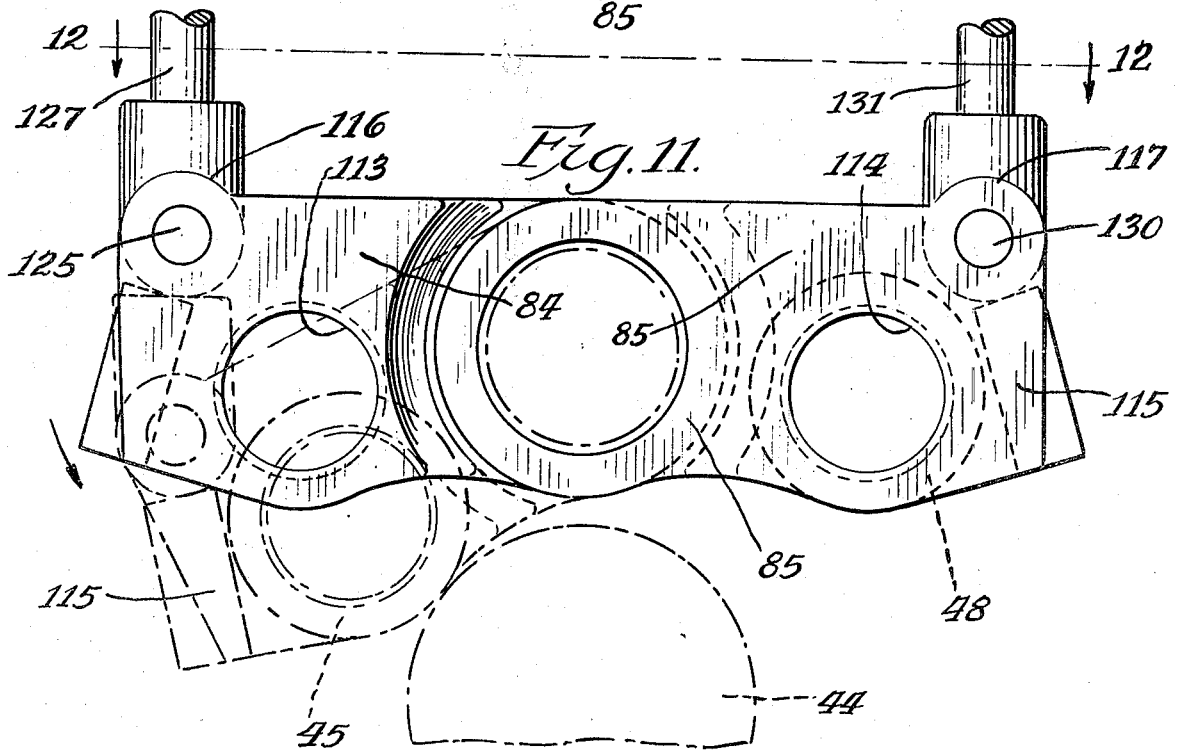
Fig. 11.

PROCESS OF ROLLING AUTOMOBILE RIMS

The invention relates to improved apparatus for rolling automobile tire rim blanks from strip material and also to a new method of operation for producing such tire rim blanks and has more particular reference to apparatus incorporating a first unitary machine for feeding and cutting said strip material, the same having co-acting relation with a second unitary machine for receiving the strip as cut by the first machine and for bending the cut strip into a substantially circular automobile tire rim blank.

Each tire rim blank as produced by the apparatus of the invention is substantially circular in formation having a diameter as pre-set by a certain spacing between the first and second unitary machines and wherein the blank is characterized by a flat portion at the lead end and by a similar flat portion at the trailing end, said flat portions being formed by separate bending rolls individually actuated.

One of the basic and novel features of the present apparatus resides in the tandem arrangement of the said unitary machines, namely the machine for feeding and cutting the strip to the pre-set length and the machine for feeding and bending the cut strip into a substantially circular shape. Considering the two machines, then three sets of feeding rolls are employed, the first set having location in the feeding and cutting machine in advance of the cutting knives with the second and third sets of feeding rolls and also the bending rolls having location in the second unitary machine for additionally feeding the strip and for bending the same to form a flat portion on the leading end and a similar flat portion on the trailing end.

Another basic and novel feature of the present apparatus resides in the tandem arrangement of the two unitary machines and wherein the first machine which incorporates a first set of feeding rolls in advance of cutting knives can be positioned in pre-selected spaced relation to the rear of the second machine which incorporates the second and third set of feeding rolls, whereby the spaced relation of the two machines determines the length of the strip material which is fed to the second machine and then cut, and since the length of the cut strip determines the circumference of the automobile rim, the same is a measure of the size of the rim to be produced by the apparatus.

A further object of the invention, is provide apparatus for rolling automobile rims which is electrically programmed in advance by the operator so that all operations take place in the desired sequence and for the full duration as required for the initial feeding of the strip material, for the cutting of the same, for additionally feeding the strip and finally for bending the strip to form the flat portions at the ends with the intermediate section being rolled into a substantially circular form.

A further and more specific object of the invention resides in providing a machine for the purposes described which will have a pair of bending rolls positioned on respective sides of the upper anvil roll and having limited bodily movement with respect to the upper anvil roll as an axis, and wherein separate and individually controlled power cylinders are provided for respectively moving the bending rolls towards and from the lower anvil roll, whereby to bend the leading and trailing ends of the strip material to form the flat portions and to bend the intermediate section of the strip into a substantially circular shape.

The product of the two-part apparatus of the invention is a tire rim blank produced from relatively heavy gauge strip material and it will be understood that other operations on the blank are required to complete a tire rim having the necessary transverse formation to receive a tire. Thus another object is to mount and support the upper anvil roll within the second unitary machine in a manner permitting adjustment of the same to accurately align the upper anvil roll longitudinally with respect to the lower anvil roll, whereby the bending and rolling operations on the cut strip will produce a tire rim blank having the precise formation as required for the additional operations to be performed on the same.

Another objective of the invention is to incorporate a printing wheel in the second unitary machine in advance of a set of feeding rolls and which will imprint information on the underside of the cut strip as the same is being fed for a bending and rolling operation, the said information essentially consisting of the date of rolling, the analysis of the metal of the strip, and the name of the company producing the tire rim blank.

With these and other objects in view, the invention may consist of novel features of construction and operation as will be more fully described and particularly pointed out in the drawings, specification and claims appended hereto.

Figure 7:
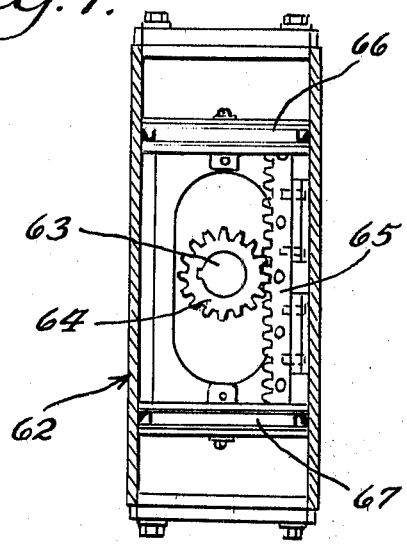
Figure 2:
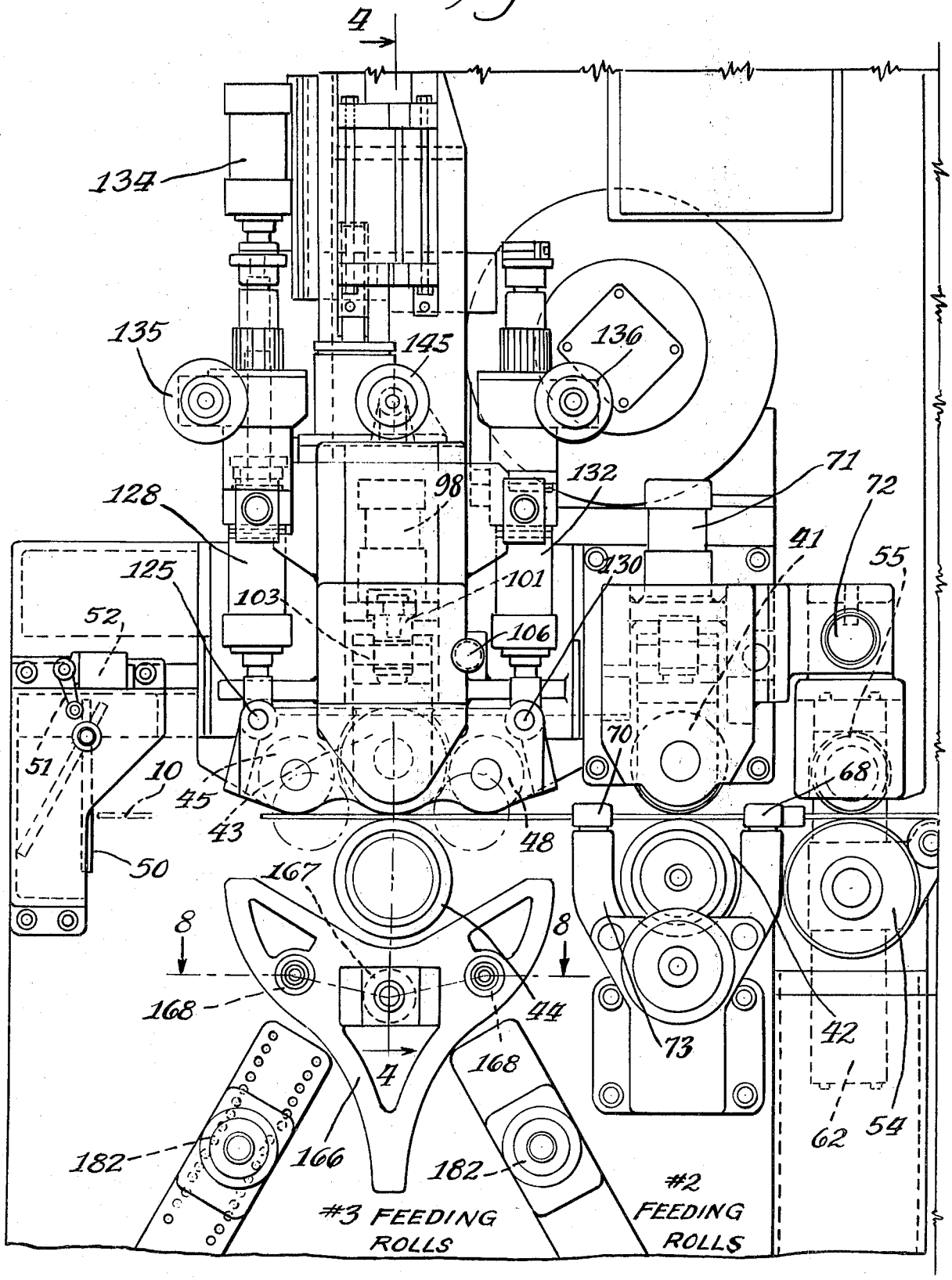
Figure 3:
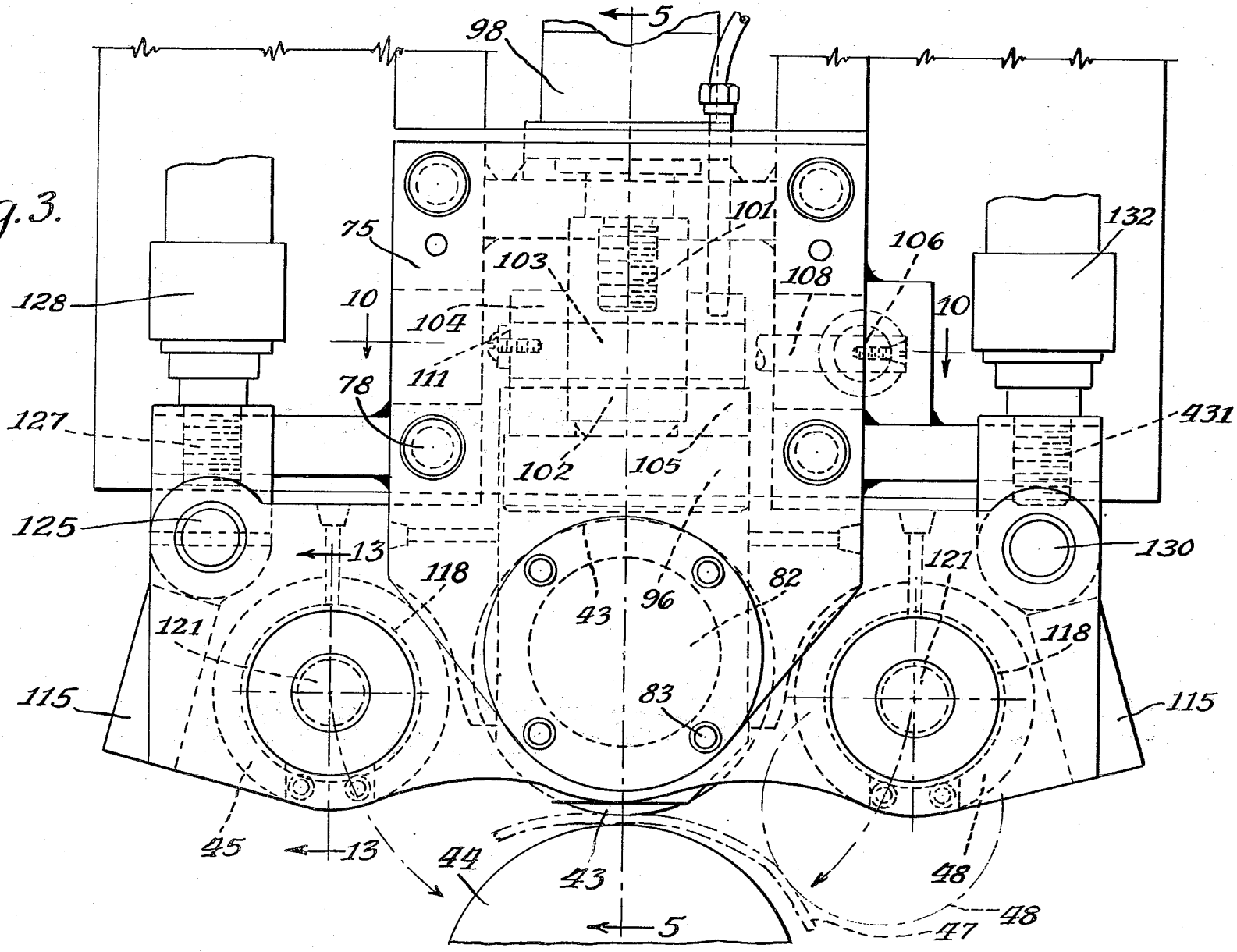
Figure 4:
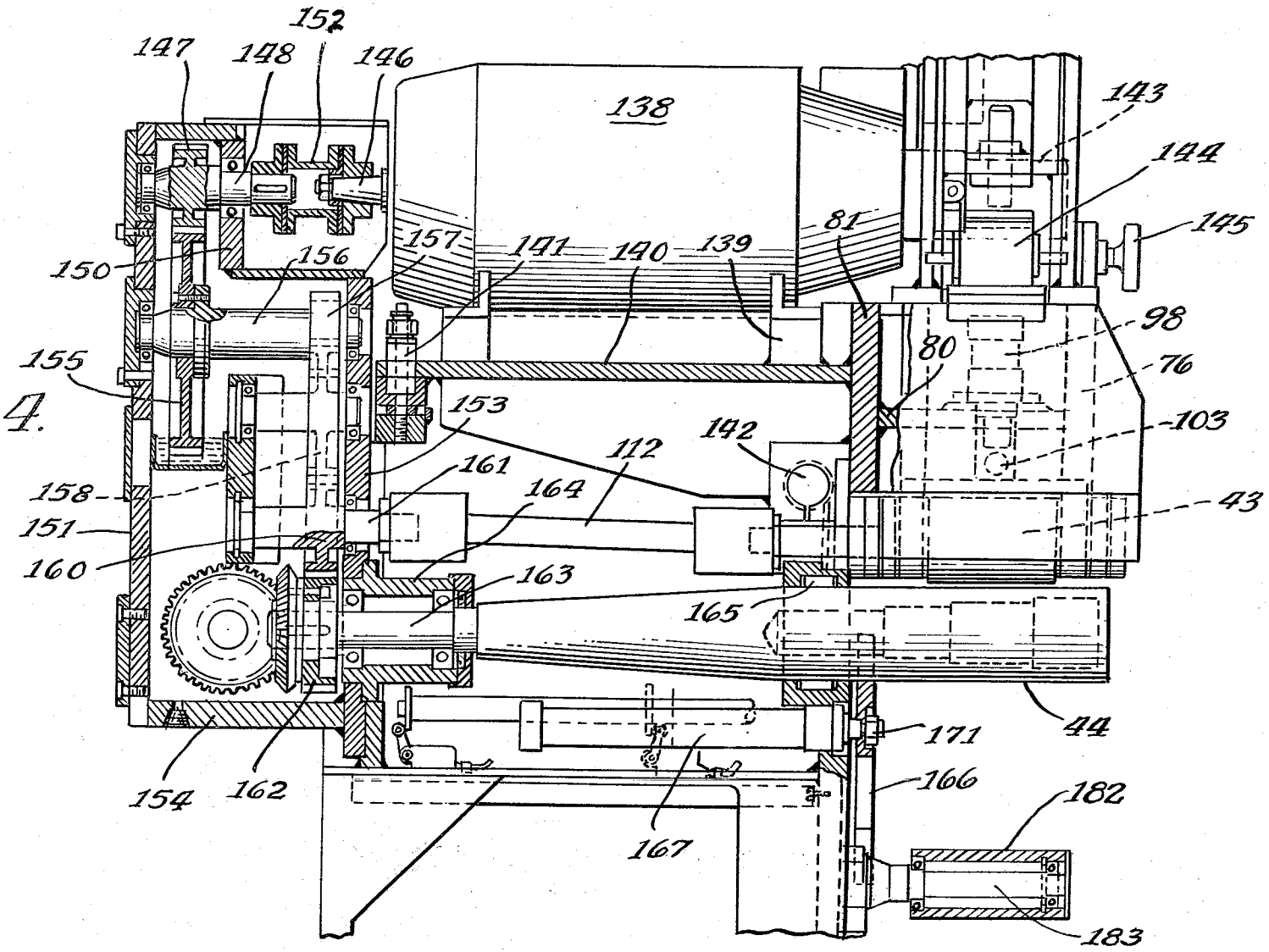
Figure 5:
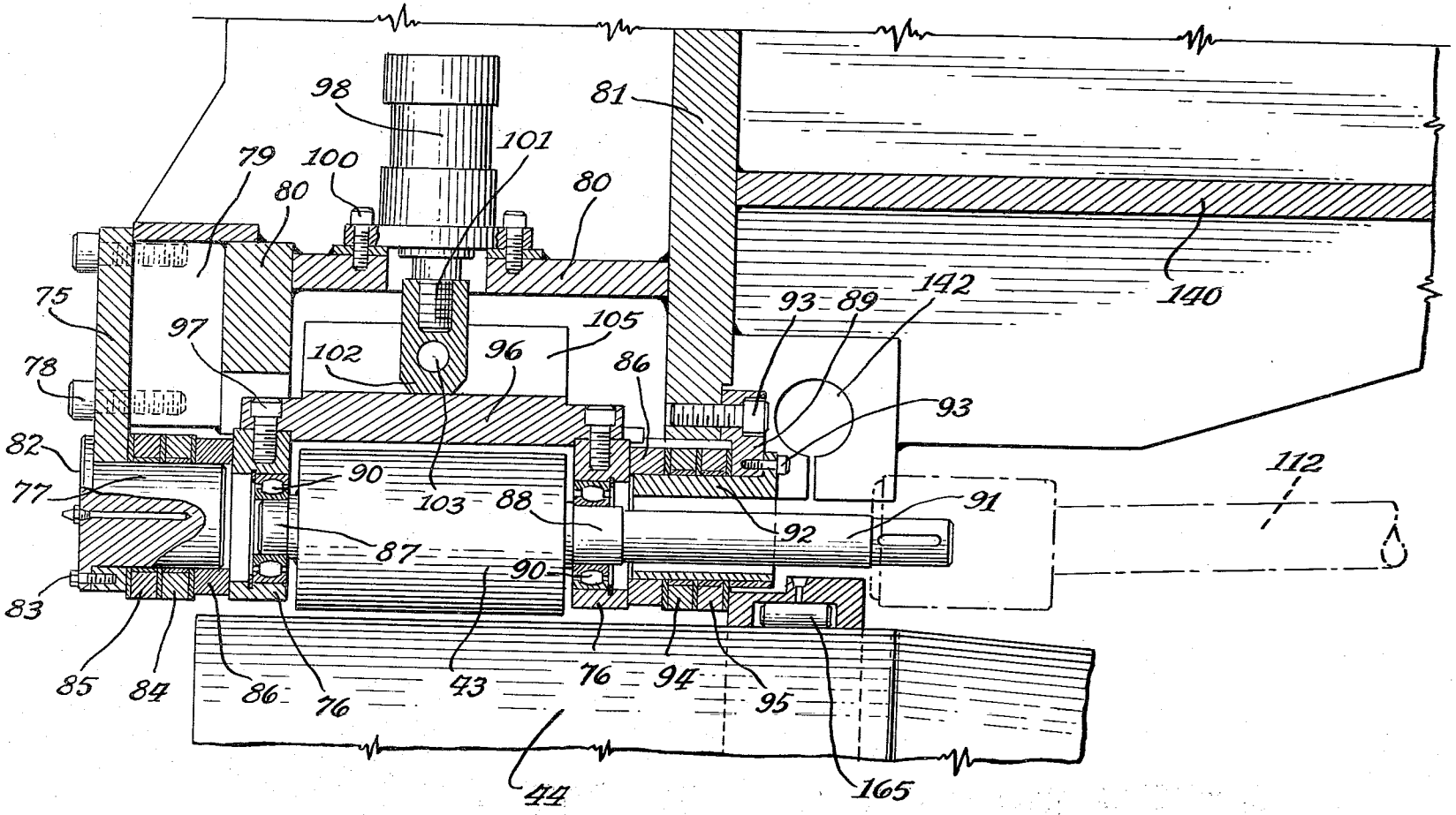
Figure 6:
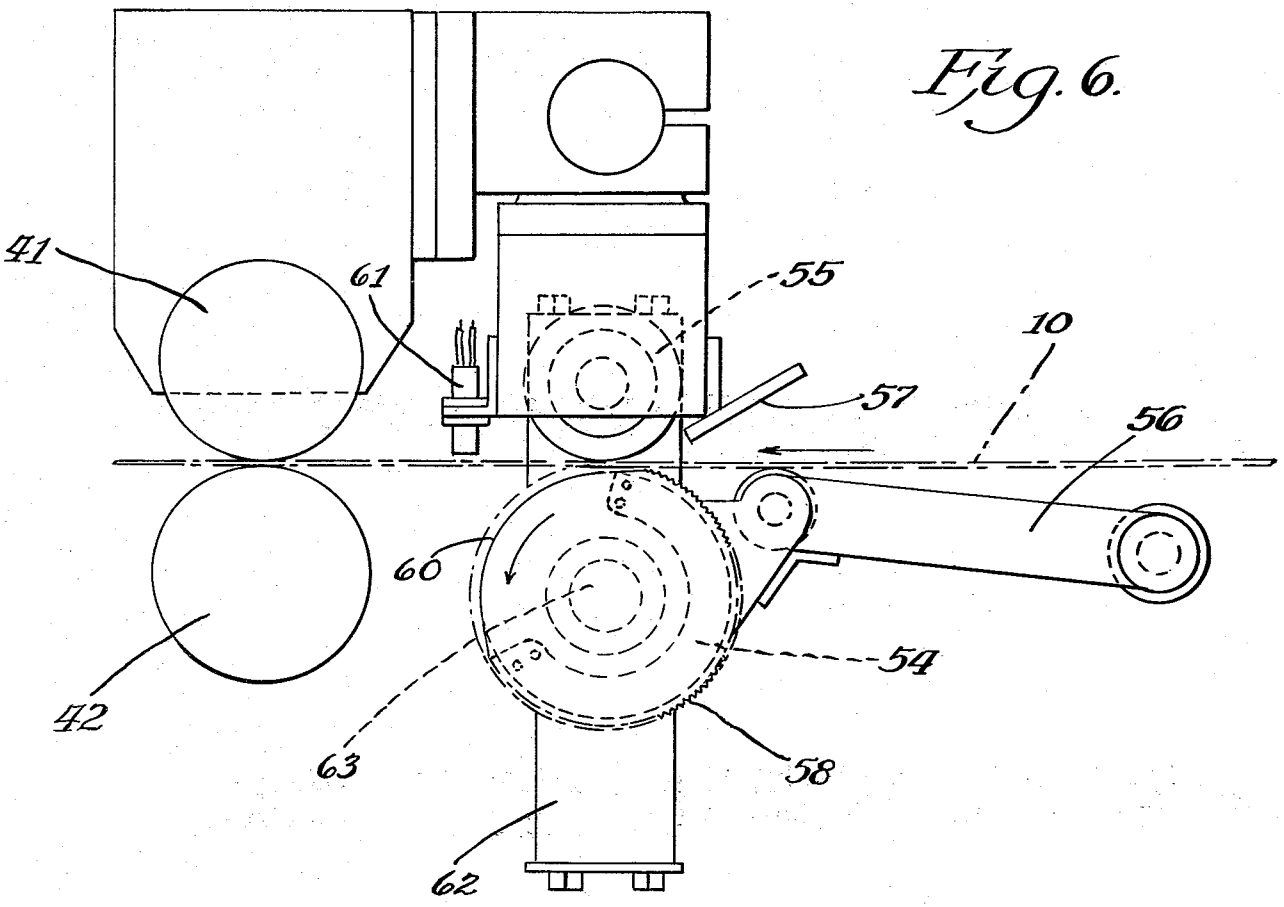
Figure 8:
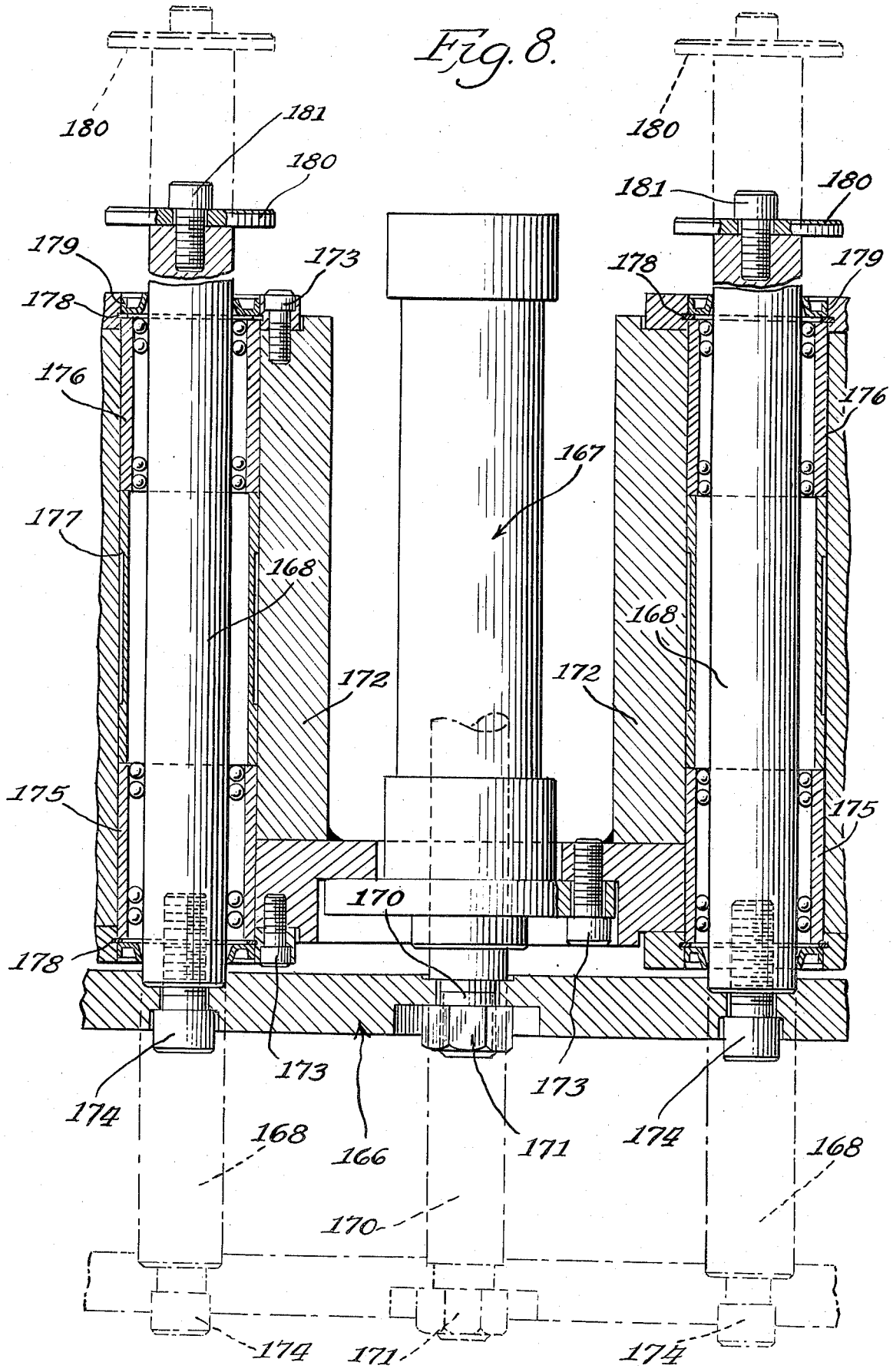
Figure 9:
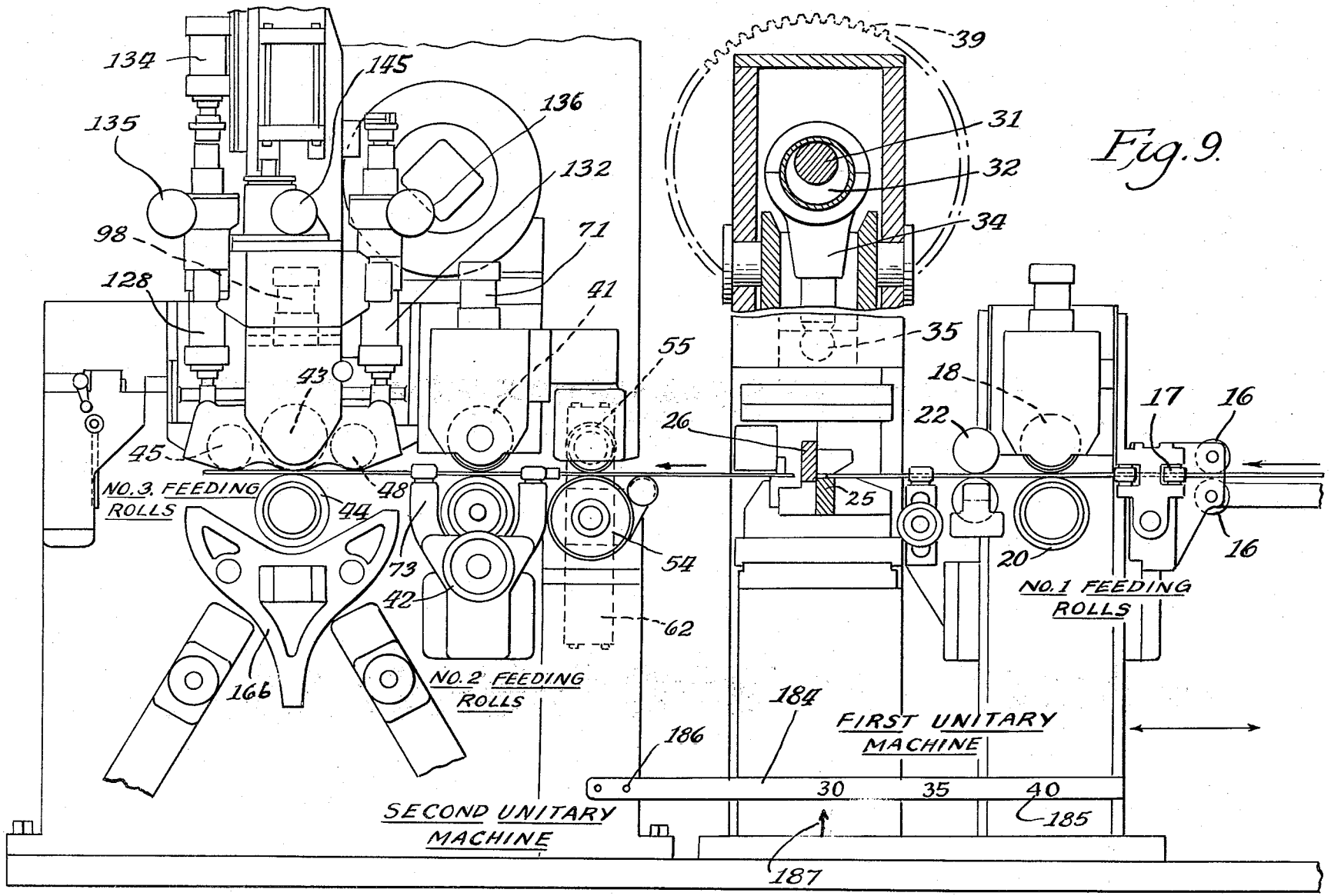
Figure 10:
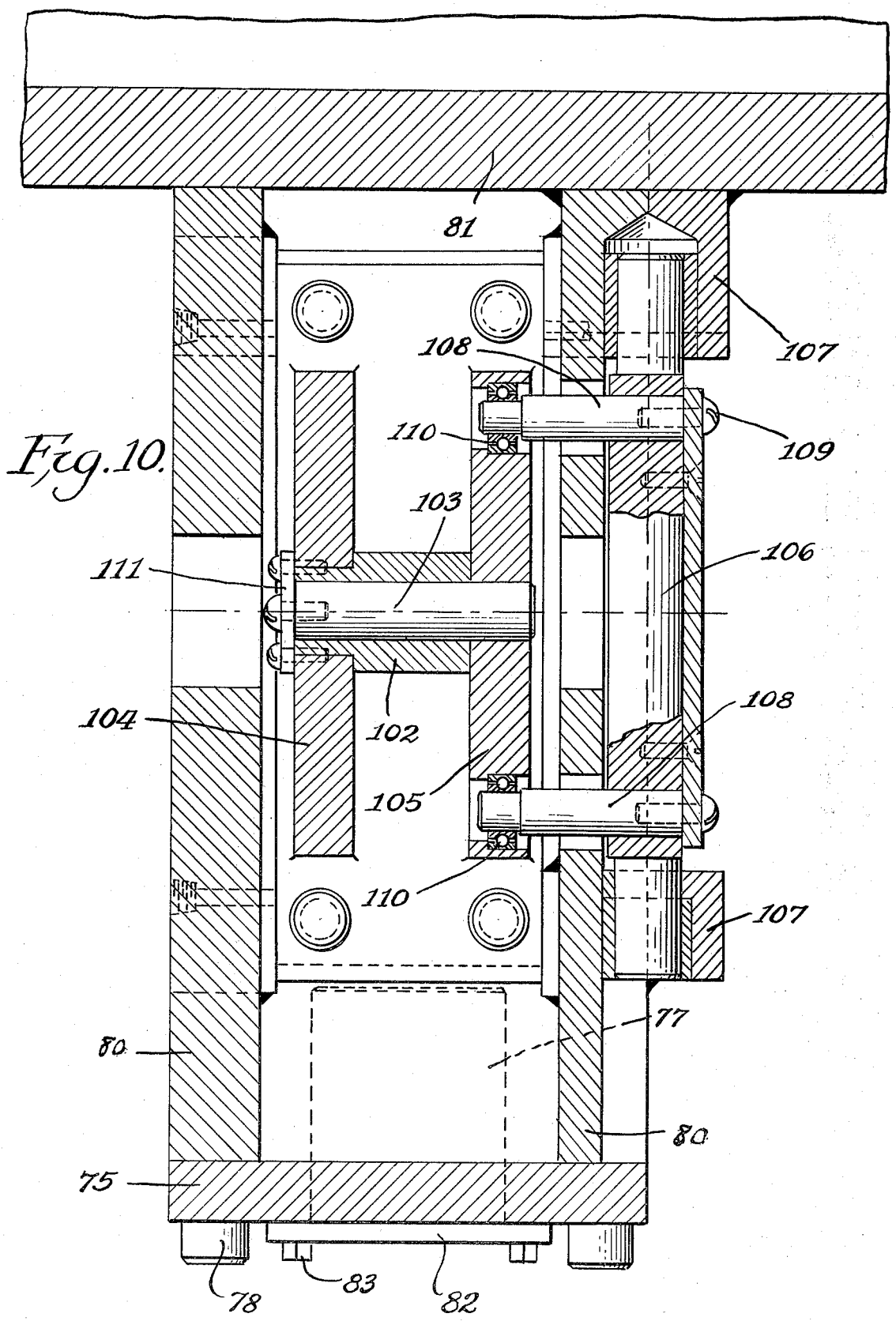
Figure 14:
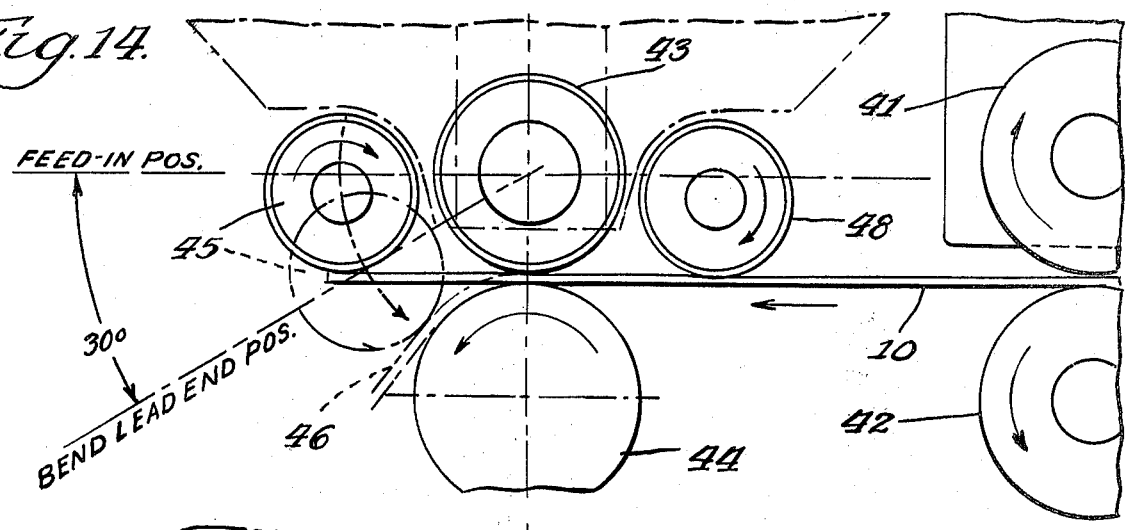
Figure 15:
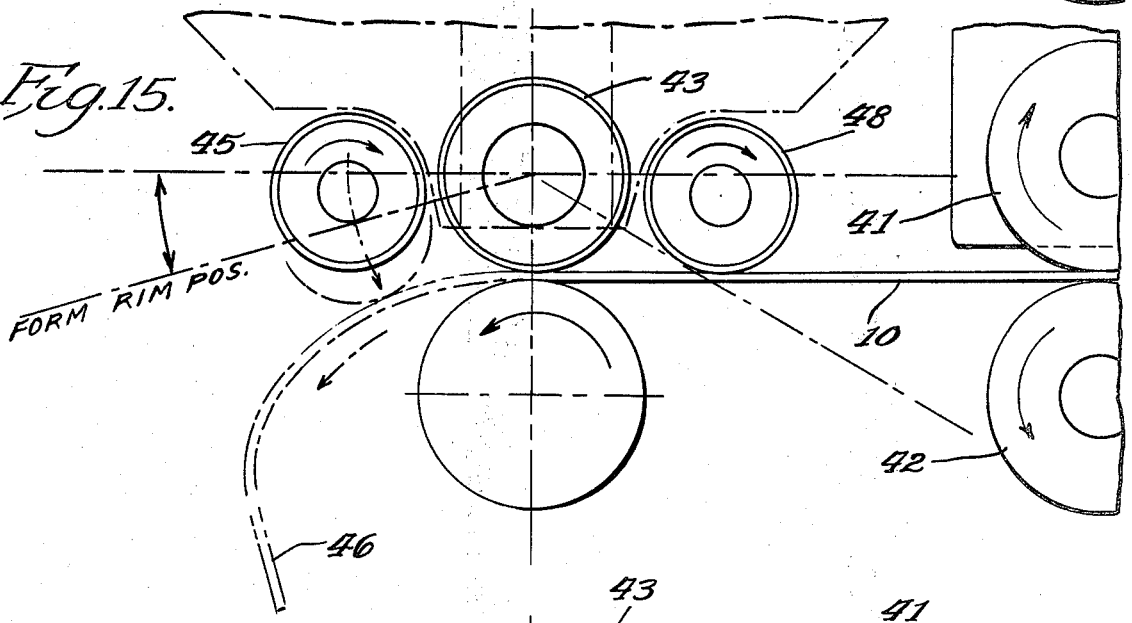
Figure 16:
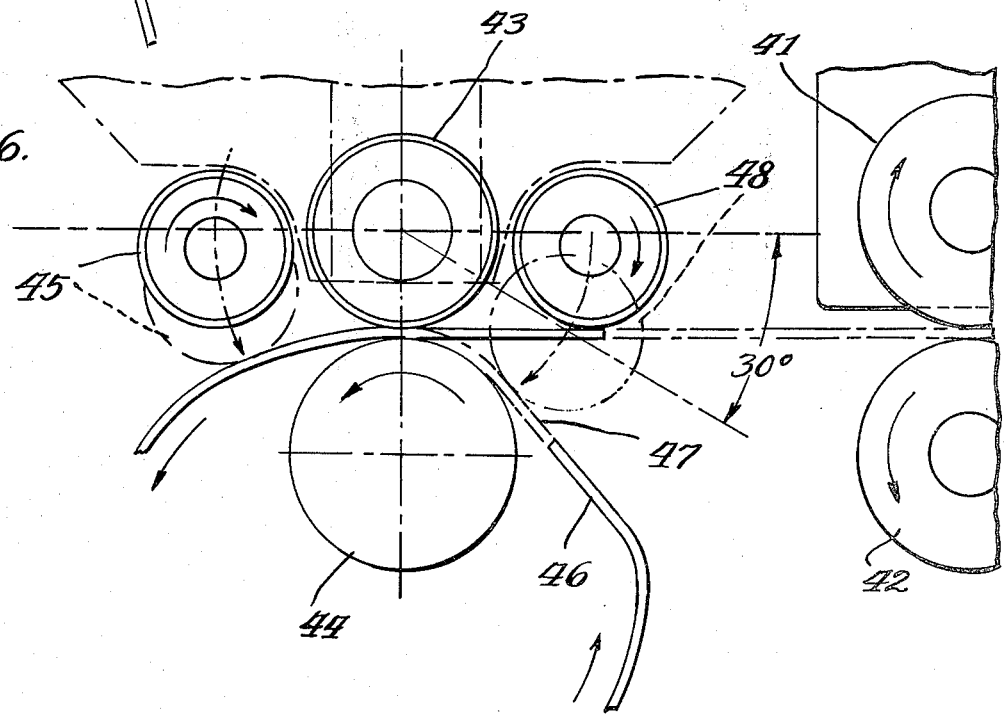

In the drawings which illustrate an embodiment of the invention and wherein like reference characters are used to designate like parts, FIG. 1 is a front elevational view, parts being shown in section, of the first unitary machine of the present apparatus, the same comprising the first feeding rolls, the reciprocable ram and the cutting knives; the intermittently rotatable eccentric, which is also shown, powers the ram to in turn reciprocate the upper cutting knife with respect to the stationary cutting knife, FIG. 2 is a front elevational view of the second unitary machine of the present apparatus and which incorporates the printing wheel, the second feeding rolls and the third feeding rolls which have the bending rolls associated therewith, FIG. 3 is a fragmentary front elevational view on an enlarged scale of the top and bottom anvil rolls comprising the third feeding rolls and which are shown in associated relation with the two bending rolls, FIG. 4 is a vertical sectional view taken on line 4—4 of FIG. 2 and showing the drive motor with connecting gearing for driving the top and bottom anvil rolls, FIG. 5 is a vertical section view taken substantially on line 5—5 of FIG. 3 and showing the journalling structure for the top anvil roll and the bending rolls, FIG. 6 is a vertical fragmentary view on an enlarged scale showing details of the printing wheel also shown in FIG. 2, FIG. 7 is a vertical sectional view of the power cylinder and gearing for driving the printing wheel, FIG. 8 is a horizontal sectional view taken on line 8—8 of FIG. 2 showing the power cylinders and structural details of the ejector device for ejecting the tire rim blank after rolling is completed, FIG. 9 is an elevational view which shows diagrammatically the first and second unitary machines to illustrate their spaced relation which is a measure of the circumference of the completed tire rim blank, FIG. 10 is a horizontal sectional view taken on line 10—10 of FIG. 3 and showing details of the levelator, FIG. 11 is an enlarged detail view in elevation of the top anvil roll and the associated bending rolls, FIG. 12 is a top plan view of the structure shown in FIG. 11, FIG. 13 is a sectional view taken substantially on line 13—13 of FIG. 3 and which shows the structural details for supporting and journalling one of the bending rolls, FIG. 14 is a diagrammatic view illustrating the initial action of the left hand bending roll in flattening the lead end of the metal strip upon feeding of the same to the upper and lower anvil rolls, FIG. 15 is a diagrammatic view illustrating the action of the left hand bending roll in rolling the tire rim blank after flattening the lead end, and FIG. 16 is a diagrammatic view illustrating the action of the left and right hand bending in completing the tire rim blank.

Referring to the drawings and in particular to FIG. 1, which illustrates in side elevation with parts in section, the first unitary machine of the present apparatus. The base of said machine may include a number of standards or uprights 11,12,13 and 14 with standard 14 supporting the frame 15 which suitably journalls the entrance rollers 16 and the side guide rollers 17 for the strip material 10. Said material in leaving the side guide rollers 17 passes between the feeding rolls 18 and 20 which provide the first feeding instrumentalities for the strip material. The rolls are suitably driven for feeding the strip 10 and pressure on the strip is applied by the power cylinder 21. The rolls 22 immediately beyond the feeding rolls comprise the anti-back-up rolls which hold the strip material and prevent movement of the same in a direction reverse to the feeding direction. From the rolls 22 the material passes between side guides 23 and into the cutting knife unit of the machine. The bottom plates 24 supported by the standards 11 and 12 in turn support the lower stationary knife 25. The strip 10 is cut by the top movable knife 26 which co-acts with knife 25 to perform the action. A stress plate 27 is associated with the movable top knife 26 so as to move therewith and said plate assumes most of the side stress during the actual cutting operation.

The top cutting knife 26 is fixed to the part 29 depending from the plate 28 and which is part of the unit assembly which reciprocates with the ram 30. The drive shaft 31 is provided with the eccentric 32 which receives the ring 33 having a depending part 34 formed with the ball 35 which has a ball and socket connection with the ram. In accordance with the invention the ram is an elongated box-like member having four sides with each side being designated by numeral 36 and wherein each side has contact with a metal button 37 carried by a wall 38 of the enclosing housing 40. The buttons hold the box-like ram in vertical alignment and allow free reciprocating movement of the ram. For a cutting operation the eccentric 32 must have a complete revolution and this is timed with the feeding rolls 18 and 20 which fed the strip material in a forward direction. A fly wheel (not shown) is continuously driven and said fly wheel has a gear connection with the large gear 39 fixed to shaft 31. A magnetic clutch is interposed between the fly wheel and gear wheel 39 and said clutch is computer energized being programmed along with the feeding rolls 18 and 20. The strip material is fed by the feeding rolls until a pre-determined length has been fed and then the computer is rendered operative to stop action of the feeding rolls and energize the magnetic clutch. The gear wheel 39 will then rotate and along with said wheel the shaft 31 and eccentric 32 will also rotate. The rotation of these parts will reciprocate the ram 30 and the upper cutting knife will cut the strip material. As stated, only one revolution of the eccentric is required to reciprocate the cutting knife 26 down and then up to complete the cutting operation on the strip material. During the cutting action and for a short time following, the feeding rolls 18 and 20 remain at rest.

Before the material 10 is cut by the knives 25 and 26, the No. 1 feeding rolls advance the strip into the second unitary machine and feeding continues until the leading end of the strip reaches the position shown in FIGS. 2 and 14. Then the computer programming is such that the rolls 18 and 20 are caused to stop and a cutting operation is caused to take place. During the feeding, the No. 2 and also the No. 3 feeding rolls are operative. The No. 2 rolls designated by numerals 41 and 42 and also the No. 3 rolls 43 and 44 are likewise computer programmed and they rotate at certain times for feeding and then they stop for a pre-determined interval. Assuming that the leading end of the strip has reached its position shown in FIGS. 2 and 14, then forward feeding is programmed along with action of the left hand bending roll 45, for bending and flattening the leading end of the strip, as at 46, as shown in FIG. 14. The body of the strip is next rolled into a circular shape and finally the trailing end is flattened at 47 by the right hand bending roll 48. In the event the strip should be advanced to the left well beyond the left hand bending roll 48, then the leading end will contact the pivotally suspended stop lever 50, FIG. 2, which is associated with the switch lever 51 of the switch 52. Any such action of the stop lever to actuate the switch will immediately stop the feeding of the strip material.

The second unitary machine provides a printing wheel 54, FIG. 6, and a pressure wheel 55 located above and adapted to apply pressure to the strip material passing between the said wheels. The strip material upon entering the second unitary machine is caused to ride on the support 56 and because of the deflector 57 the material will enter between the printing wheel 54 and the pressure wheel 55. A major portion of the circumference of the wheel is equipped with a printing plate 58 containing raised printing characters and the remaining portion of the circumference is under-cut at 60 for about the thickness of the material. The printing plate 58 contains indicia which is impressed on the underside of the strip the same identifying for example the name of the company, listing an analysis of the material of the strip, and giving the date of the rolling of the tire rim blank. When the strip initially enters it passes between the pressure wheel and the top under-cut part of the printing wheel. Further advancing of the strip locates the leading end under the proximity switch 61 which initates a programming action that controls the power cylinder 62, FIG. 7.

The power cylinder journals the main drive shaft 63 on which the printing wheel 54 is mounted and fixed. Within the power cylinder, the gear pinion 64 is fixed on the main drive shaft 63 and the pinion meshes with the rack 65 that connects the top and bottom pistons 66 and 67. When the strip material passes the proximity switch 61, the programming is such as to cause the bottom piston 67 to move up and rotate the printing wheel 54 in a counter clockwise direction. The wheel is additionally rotated by the advancing strip and at this time the actual printing on the underside of the material takes place. Since the printing wheel 54 is undercut, the material can pass without any rotation of the wheel and this takes place following a printing impression until the trailing end passes out from under the proximity switch 61. The programming of the power cylinder is such as to cause the upper piston 66 to move down and rotate the printing wheel into its initial position, where it is ready for another operating cycle.

Upon leaving the printing unit, FIG. 2, the strip material passes between the side guides 68, then between the rolls 41 and 42 of the No. 2 feeding rolls, and between the front side guides 70. The upper roll 41 is suitably connected to the piston of the power cylinder 71 and the unit including the upper roll, the power cylinder and the connections is supported at 72 from the frame of the second unitary machine. The power cylinder is employed to apply pressure to the strip material for feeding the same and the lower roll 42 is suitably driven for said feeding purposes with computer programming of the same taking place during operation of the machine. The yoke 73 provides a support for the side guides 68 and 70 with lateral adjustment being possible since the strip material may vary in width.

The bending rolls 45 and 48 are associated with the No. 3 feeding rolls comprising the upper anvil roll 43 and the bottom anvil roll 44. As previously explained, the forward feeding of the strip is programmed to stop when the forward end of the strip reaches its position as shown in FIG. 14 which is just under the left hand bending roll 45. The forward feeding of the strip no sooner stops than the bending roll 45 is caused to move down to its lowest position for bending the leading end into a flat portion 46. The bending takes place against the lower anvil roll 44. Reference is made to FIGS. 5 and 12 for a detailed showing of the structure for journalling and pivotally supporting the bending rolls so that pivotal movement of the same takes place with respect to the axis of the upper anvil roll 43. The supporting plate 75 is suitably supported from the frame 79 and the same is formed with an opening for receiving and mounting the stud shaft 77. Frame piece 79 has the plate 75 secured thereto by the bolts 78 and the adjacent frame member 80 is welded to the top plate section which is in turn welded to the intermediate wall 81. The cap element 82 is secured to the stud shaft 77 by screws 83 and the stud shaft journalls the arms 84 and 85, FIG. 12, which have a location on the stud shaft between the plate 75 and the fixed frame support 86 which bears against the movable frame piece 76.

The wall of frame piece 76 is apertured for receiving the left hand journalling stud 87 of the upper anvil roll 43 and which has approximate alignment with the stud shaft 77. Stud 87 and the right hand stud part 88 are provided with bearings 90 and which as regards both 87 and 88 are mounted in frame pieces 76 adapted to have limited movement so that they only bear against the fixed frame members 86. The journalling stud 88 is extended to provide the driving shaft 91 which extends through the cylindrical stud part 92 similar to the stud part 77, the cylindrical part being suitably supported by members 86 and 89, the latter having securement to wall 81 by the bolts 93. Arms 94 and 95 are journalled on stud part 92 and said arms are in all respects similar to arms 84 and 85. Inside arms 84 and 94 journal and support bending roll 45 whereas the outside arms 85 and 95 journal and support bending roll 48. Both bending rolls have pivotal movement with respect to anvil roll 43 and both rolls are actuated by power cylinders.

Frame pieces 76 on respective sides of the top anvil roll 43 are connected by the member 96, said member being secured to the frame pieces by the bolts 97. The power cylinder 98 is suitably secured to the top wall 80 by the bolts 100 and the depending piston rod 101 is threaded to the clevis part 102. The clevis pin 103 extends through the clevis part 102 and the pin at respective ends enters openings in the upright wall portions 104 and 105 FIG. 10, and which are integral with the connecting member 96. Accordingly the said wall portions, the connecting member and the frame pieces, as a unit assembly, carry the top anvil roll. As heretofore stated, it will be understood that the carrying unit can be moved vertically to a limited extent when actuated by the power cylinder 98 towards and from the lower anvil 44 since the frame pieces only bear against the frames members 86. In order that both ends of the carrying unit will move accurately and to an equal extent so as to maintain a parallel relation with the bottom anvil roll, a levelator is required and this piece of equipment is shown in FIG. 10.

The numeral 106 indicates the levelator rod which is mounted for rotation in the journalling blocks 107, one being fixed to a frame piece 80 and the other extending from the wall 81. At spaced locations along the length of the levelator rod the same has a pair of levelator pins 108 fixedly secured thereto by the screws 109. The pins extend through openings in the frame piece 76 and they terminate in openings in the wall 105 where spherical bearings are provided at 110 for connecting the terminal end of each levelator pin to the said wall. The clevis pin 103 has a tight fit in an opening in wall 105 and the same extends through wall 104 where it receives the retainer 111. As described the clevis pin passes through the clevis part 102 and thus the depending end 101 of the piston rod of the power cylinder 98 is operatively connected to the connecting wall 96 and which by means of the frame pieces 76 carries the top anvil roll for rotation. The drive to the said anvil roll is provided by the driving member 112 which connects with the keyed end of the driving extension 91. Of course the operation of the power cylinder is programmed in timed relation to both the feeding rolls which advance the strip material and also to the bending rolls which bend and roll the strip. At times the upper anvil roll is forced downwardly to apply pressure to the strip passing between the rolls, namely 43 and 44. At other times the top anvil roll is lifted to space it from the bottom roll so that the strip material can pass between the rolls while they are at rest.

Reference is made to FIGS. 11,12 and 13 for a showing of the structure provided for supporting and journalling one of the bending rolls namely 45. The structure as regards bending roll 48 is not completely shown but it will be understood that the same is a duplicate of that shown for roll 45. The arms 84 and 85 mounted on the stud shaft 77, FIG. 5, and also the arms 94 and 95 mounted on the stud part 92 are reduced in thickness so as to overlap at the respective stud shafts. Also each arm has an intermediate opening such as 113 for arms 84 and 94 and 114 for arms 85 and 95. The arms each terminate in a part 115 which provides the hub portions 116 for arm 84 and 117 for arm 85 as shown. The spaced arms 84 and 94 have a groove in their openings 113 for receiving a retaining ring 118 which holds in place a bearing device 120 for journalling the stud shaft 121 projecting from the left hand side of the bending roll. The stud shaft projecting from the right hand side of the bending roll namely 122 is mounted and journalled in a similar manner in arm 94.

The spaced arms 84 and 94 for the bending roll 45 are operatively joined by the rod 125 which is mounted at its respective ends in the hub portions 116. A spacer 126 is located on the rod between the hub portions and centrally of the rod the same connects with the depending piston rod 127 of a power cylinder 128, FIGS. 2 and 3. The spaced arms 85 and 95 for the roll 48 are also joined by a rod 130 which is respectively fixed to the hub portions 117 and which also has a spacer. The rod 130 centrally thereof is connected to the depending piston rod 131 of a power cylinder 132.

The power cylinders 128 and 132 are computer programmed and when they are operative they move the bending rolls 45 and 48 down from a retracted position to an operative extended position and then the power cylinders reverse and move the bending rolls up into a retracted position again. Considering bending roll 45, its power cylinder becomes operative when the strip is fed forwardly and stopped with its leading end just under the roll, FIG. 14. Then the roll is moved down to its maximum position adjacent the bottom anvil roll 44 to form the flat portion 46. Next the roll is retracted upwardly to an intermediate position for rolling the rim blank which immediately takes place upon the forward feeding of the strip being resumed, FIG. 15. The power strokes of cylinder 128 to move its bending roll downwardly and retract the same to a mid position and finally to a full retracted position is regulated by the power cylinder 134 having the adjustment hand wheel 135. When the rolling of the tire rim blank is completed the bending roll 45 is retracted to its up position where it is ready for another cycle of operations.

However, when rolling is completed, the forward feeding of the strip is momentarily stopped and power cylinder 132 is rendered active to move the bending roll 48 down to its maximum position adjacent the anvil roll 44 for forming the flat portion 47 on the trailing end of the strip, FIG. 16. Then the said bending roll is retracted to its initial position and the extent of these actions can be adjusted by the hand wheel 136. After the flat portion has been formed, the tire rim blank is ready to be ejected from the bottom anvil roll 44 and structure for doing so is shown in FIG. 8.

The drive for the anvil rolls is shown in FIG. 4 where 138 indicates the drive motor which is supported by the pads 139 on the plate structure 140 pivotally anchored to the frame of the machine by the pivot pin device 141 and also having a connection with the frame at 142. The enclosure 143 extending from the right hand side of the motor 138 is associated with a jactuator device 144, the same having a jack screw arrangement and an adjusting hand wheel 145 conveniently presented for access by the operator. A drive shaft 146 projects from the left hand side of the motor 138 and said shaft drives the pinion 147 fixed to the end of shaft 148 which is ball bearing mounted in walls 150 and 151. A coupling 152 is provided for connecting the motor drive shaft 146 to shaft 148. Wall 151 is the outer wall, 153 is the inner wall and 154 is the bottom wall of a gear box for housing the gear train to be described. The pinion 147 meshes with and drives a gear 155 on shaft 156 which also mounts a pinion 157 at its opposite end having meshing relation with and driving an idler gear 158. From 158 the drive continues to gear 160 fixed to shaft 161 which is journalled in an intermediate wall and in wall 153, from which the shaft extends outwardly for operative connection with the member 112 previously described, FIG. 5. The said member accordingly drives the upper anvil roll 43. Gear 160 drives the gear 162 fixed on the driving end 163 of the bottom anvil roll 44. The said roll is cantilevered by means of the cylindrical member 164 which provides the required spaced bearings generally necessary for a cantilevered arrangement. The end of the anvil roll 44 beyond the frame supported bearing 165 is free of any axial obstruction and this is necessary since the tire rim blank after rolling must be ejected from the bottom anvil roll.

Ejection of the completed tire rim blank is done by the ejector plate 166, FIG. 8, which is actuated outwardly for ejection and then retracted to its initial position by the power cylinder 167 which is programmed as regards its operations so as to coincide in timing with the operations of the other equipment of the second unitary machine. The plate has a functional Y formation as shown in FIG. 2, and the same is supported for reciprocating movement with respect to the lower anvil roll 44, by the supporting rods 168 located on respective sides of the power cylinder 167. Said cylinder has a forwardly extending piston rod 170 which is secured to the ejector plate 166 by the securing nut 171. The power cylinder is in turn fixedly secured at its forward end to frame work 172 by the securing bolts 173. The supporting rods 168 help to stabilize the reciprocating movements of the piston rod and they also help to support the ejector plate especially when the plate is outwardly positioned. Each supporting rod is housed and mounted for reciprocating movement in a tubular structure consisting of ball-equipped cylindrical bushings 175 and 176 located at respective ends of the tubular structure and having a spacer sleeve 177 positioned between. The cylindrical bushings are each held in place by the spacer sleeve and by the retaining ring 178, the said ring being associated with an oil seal 179. Also each supporting rod 168 has a stop member 180 secured by the bolt 181 to its end which projects beyond the ball-equipped bushing 176. The stop members limit the outward travel of the supporting rods for ejecting a completed tire rim blank from the anvil roll 44. Prior to being ejected, the completed tire rim blank is additionally supported on the forwardly extending rollers 182, FIG. 4, mounted in a ball bearing manner on the studs 183 fixed to and projecting from the frame of the machine.

An important aspect of the invention resides in the feature of spacing the first unitary machine a preselected distance behind the second unitary machine. In FIG. 9 the two machines are shown in a diagrammatic arrangement for illustrating this novel feature. The second machine carries a ruler 184 adjacent its base which is provided with indicia 185 indicating certain spacings between the two machine such as may be preselected for rolling rim blanks of the desired size. The ruler is fixed at 186 to the second machine and the same extends to the right for association with the pointer 187 located on the first machine and aligned with the cutting knives 25 and 26. The pointer is at 30 in FIG. 9, and accordingly it will be understood that this is a measure of the length of the strip cut with this spacing. The length of the cut strip determines the circumference of the completed tire rim blank and thus the same is a measure of the size of the blank. The first machine can be moved to the right for increasing the distance between the two machines thereby increasing the length of the cut strip of material. Thus the spacing between machines can be preselected by the operator for obtaining tire rim blanks of the desired size.

The apparatus of the invention has been designed to produce automobile tire rim blanks from metal strip material fed to the first unitary machine from a coil of said material. The finished tire rim blank is a length of said strip that has been formed into a unique circular shape since the leading and trailing ends have been flattened to facilitate subsequent butt welding operations. The leading end of the strip enters the first machine to pass between the spaced rolls 18 and 20, between the spaced cutting knives 25 and 26 and into the second machine between the rolls 54 and 55 of the printing device. With the strip between the rolls, 18 is moved down by the cylinder 21 to apply the pressure for the bite necessary for feeding. However the cutting knives remain open. The leading end of the strip under the proximity switch 61 triggers the power cylinder 62 and then the strip enters between the feeding rolls 41 and 42 which are likewise closed by their cylinder 71 to provide the necessary bite on the strip. Now the strip is being fed forwardly by both #1 and #2 feeding rolls and presently the #3 rolls become operative but only for a short time until the leading end is positioned under the bending roll 45, whereupon feeding is momentarily stopped. Now it is possible for the cutting knives to become operative to cut the strip and at the same time the bending roll is actuated by cylinder 128 to move down to its maximum position adjacent the bottom anvil roll 44 for forming the flat portion 46. When this operation is completed, the bending roll is retracted to its mid-position by cylinder 128 controlled by cylinder 134 and upon forward feeding of the strip being resumed the roll 45 is effective in rolling the body of the strip into a circular shape. At this time the strip is being fed by #2 and #3 feeding rolls and the said bending roll 45 is being rotated to facilitate the rolling operation. The cutting knives, having been actuated to cut the strip, are now separated, since knife 26 has moved up, so that the #1 feeding rolls can again be rendered operative to feed the next strip forwardly into the second machine whereupon the same operations are performed. When the rolling is completed the feeding of the first strip is stopped and the bending roll 48 is actuated by cylinder 132 to flatten the strip at 47. The bite on the completed tire rim blank must now be released by movement of the upper anvil roll 43 in an up direction by cylinder 98 and then the cylinder 167 is rendered operative to eject the tire rim blank from off the bottom anvil roll 44.

An important feature of the structure disclosed in FIG. 4 resides in the hinge device 141 and the pivot arrangement designated by numeral 142. It will be understood that during operation considerable pressure is exerted on the rolls 43 and 44 and this pressure is particularly concentrated at the outer ends of said rolls. After an extended period of operation, the pressure tending to separate the rolls will space the outer ends to a greater degree than the inner ends. Of course precise parallelism is required for proper and accurate rolling so as to produce a satisfactory product. When the space at the outer ends of the rolls increases beyond a set limit or when the operator observes a thickening of the tire rim blank along this side, then the operator will rotate the pivot pin 141 in a direction to cause the platform 140 to move up and the rotative adjustment around the axis 142 will move the outer end of roll 43 in a down direction towards the lower roll 44. This adjustment will thus compensate for any excess spacing at the outer ends of the rolls due to the excessive pressures to which they are subjected during operation.

What is claimed is:

1. In a method of producing tire rim blanks from strip material, the steps which include feeding the strip material between spaced knives of a cutting unit provided by a first machine, directing the strip into a second machine in tandem relation with the first, continuing the feeding of the strip until the leading end of the strip enters between a pair of anvil rolls provided by the second machine, stopping the feeding of the strip, actuating the cutting knives to cut the strip, bending the leading end of the strip, while the feeding is stopped against one of the anvil rolls to form a flat portion, continuing the feeding of the strip between the anvil rolls and rolling the body of the strip into a circular shape, again stopping the feeding of the strip when rolling is completed, bending the trailing end of the strip when feeding is stopped to form another flat portion thereon, and then ejecting the formed tire rim blank from the machine.

2. A method of producing tire rim blanks as defined by claim 1, wherein the bending of the strip to form the flat portions on the leading and trailing ends, respectively, is performed by forcing a pair of bodily movable bending rolls that are individually actuated from respective retracted positions to extended positions against the respective ends of the strip.

3. A method of producing tire rim blanks as defined by claim 2, wherein the step of rolling the body of the strip into a circular shape is performed by forcing one of said bending rolls from a retracted position to a mid position against the strip as said strip is being fed between said pair of anvil rolls.

4. In a method of rolling automobile tire rim blanks from metal strip material, the steps which include feeding the strip to a first machine and passing the strip between the rolls of a first feeding unit and then between spaced knives of a cutting unit, directing the strip as it leaves the cutting unit into a second machine and continuing the feeding of the same until its leading end enters a third feeding unit comprising a pair of anvil rolls, stopping the feeding of the strip, actuating the knives of the cutting unit to cut the strip, bending the leading end of the strip while the feeding is stopped to form a flat portion thereon by forcing a bodily movable bending roll, having coaction with the anvil rolls from a retracted position to an extended position against the leading end of the strip, continuing the feeding of the strip between the anvil rolls and rolling the body of the strip into a circular shape by feeding the same into contact with said bending roll, again stopping the feeding when rolling is completed, and then flattening the trailing end of the strip while the feeding is stopped by forcing a second bodily movable bending roll from a retracted position to an extended position against said trailing end of said strip, and finally ejecting the formed tire rim blank from the second machine.

5. In a method of rolling automobile tire rim blanks from a coil of metal strip material, the steps which include directing the strip material as it unwinds from the coil to first feeding rolls located in a first machine, continuing the feeding by said first feeding rolls to feed the strip forwardly between spaced cutting knives and then between the rolls of a printing device located in a second machine, continuing the feeding of the strip and additionally feeding the same by second feeding rolls located in the second machine until the leading end of the strip is positioned adjacent a third set of feeding rolls, stopping the feeding of the strip, cutting the strip by actuation of said cutting knives, and while the feeding is stopped bending the leading end of the strip by forcing a bending roll from a retracted position to an extended position against the leading end of the strip associated with the third set of feeding rolls to form a flat portion thereon, locating the bending roll in a mid position, and again feeding the strip forwardly into contact with the said mid-positioned bending roll to roll the body portion of the strip into a circular shape, again stopping said feeding of the strip and flattening the trailing end while the feeding is stopped by forcing a second bodily movable bending roll from a retracted position to an extended position against the trailing end of the strip, and finally ejecting the formed tire rim blank from the second machine.

* * * * *